US007554027B2

(12) United States Patent
Moffatt

(10) Patent No.: US 7,554,027 B2
(45) Date of Patent: Jun. 30, 2009

(54) METHOD TO PLAYBACK MULTIPLE MUSICAL INSTRUMENT DIGITAL INTERFACE (MIDI) AND AUDIO SOUND FILES

(76) Inventor: Daniel William Moffatt, 6433 Parnell Ave., Edina, MN (US) 55435

( * ) Notice: Subject to any disclaimer, the term of this patent is extended or adjusted under 35 U.S.C. 154(b) by 0 days.

(21) Appl. No.: 11/633,730

(22) Filed: Dec. 5, 2006

(65) Prior Publication Data

US 2007/0131098 A1 Jun. 14, 2007

Related U.S. Application Data

(60) Provisional application No. 60/742,487, filed on Dec. 5, 2005.

(51) Int. Cl.
*G10H 7/00* (2006.01)
*G10H 1/00* (2006.01)

(52) U.S. Cl. ..... 84/645; 84/477 R; 84/609

(58) Field of Classification Search ..... 84/645, 84/609, 477 R
See application file for complete search history.

(56) References Cited

U.S. PATENT DOCUMENTS 4,527,456 A * 7/1985 Perkins et al. ..... 84/654
4,783,812 A 11/1988 Kaneoka
4,787,051 A 11/1988 Olson
4,852,443 A * 8/1989 Duncan et al. ..... 84/733
4,998,457 A * 3/1991 Suzuki et al. ..... 84/600
5,027,115 A 6/1991 Sato et al.
5,181,181 A 1/1993 Glynn
5,315,057 A * 5/1994 Land et al. ..... 84/601
5,442,168 A * 8/1995 Gurner et al. ..... 463/36
5,502,276 A * 3/1996 Jameson ..... 84/645
5,513,129 A * 4/1996 Bolas et al. ..... 703/13
5,533,903 A * 7/1996 Kennedy ..... 434/307 R
5,589,947 A * 12/1996 Sato et al. ..... 386/96
5,670,729 A * 9/1997 Miller et al. ..... 84/609
5,691,898 A * 11/1997 Rosenberg et al. ..... 700/85
5,734,119 A * 3/1998 France et al. ..... 84/622
5,875,257 A * 2/1999 Marrin et al. ..... 382/107
5,973,254 A * 10/1999 Yamamoto ..... 84/609
5,977,471 A * 11/1999 Rosenzweig ..... 84/633
6,075,195 A * 6/2000 Gabai et al. ..... 84/645
6,096,961 A * 8/2000 Bruti et al. ..... 84/609
6,150,599 A * 11/2000 Fay et al. ..... 84/609
6,175,070 B1 * 1/2001 Naples et al. ..... 84/609
6,222,522 B1 * 4/2001 Mathews et al. ..... 345/156
6,232,541 B1 * 5/2001 Kumagai ..... 84/645
6,313,386 B1 11/2001 Capobianco et al.
6,429,366 B1 * 8/2002 Terada ..... 84/645
6,462,264 B1 * 10/2002 Elam ..... 84/645
6,743,164 B2 * 6/2004 Airaudi et al. ..... 600/27

(Continued)

FOREIGN PATENT DOCUMENTS

WO WO 95/21436 8/1995

*Primary Examiner*—Lincoln Donovan
*Assistant Examiner*—Christina Russell
(74) *Attorney, Agent, or Firm*—Nathan J. Witzany; Dorsey & Whitney, LLP

(57) ABSTRACT

The present invention is method for the playback of multiple MIDI and audio files. More specifically, it is an interactive music playback method that enables real time synchronization, quantization, music and sound modification and management of playback resources. Further, the present invention provides a method of music performance using various sound files.

21 Claims, 4 Drawing Sheets

U.S. PATENT DOCUMENTS 6,881,888 B2 * 4/2005 Akazawa et al. ..... 84/604
7,045,698 B2 * 5/2006 Miyamoto ..... 84/477 R
7,099,827 B1 * 8/2006 Tamura ..... 704/270
7,126,051 B2 * 10/2006 Fay et al. ..... 84/609
7,129,405 B2 * 10/2006 Moffatt et al. ..... 84/600
7,319,185 B1 * 1/2008 Wieder ..... 84/609
2001/0015123 A1 * 8/2001 Nishitani et al. ..... 84/615
2001/0045154 A1 * 11/2001 Aoki ..... 84/609
2002/0002898 A1 * 1/2002 Schmitz et al. ..... 84/645
2002/0007720 A1 * 1/2002 Aoki et al. ..... 84/609
2002/0044199 A1 * 4/2002 Barzebar et al. ..... 348/14.01
2002/0112250 A1 * 8/2002 Koplar et al. ..... 725/153
2002/0121181 A1 * 9/2002 Fay et al. ..... 84/609
2002/0198010 A1 * 12/2002 Komsi et al. ..... 455/466
2003/0037664 A1 * 2/2003 Comair et al. ..... 84/609
2004/0069119 A1 4/2004 Juszkiewicz
2004/0089142 A1 * 5/2004 Georges et al. ..... 84/610
2004/0139842 A1 * 7/2004 Brenner et al. ..... 84/477 R
2004/0154461 A1 * 8/2004 Havukainen et al. ..... 84/645
2004/0266491 A1 * 12/2004 Howard et al. ..... 455/567
2005/0071375 A1 * 3/2005 Houghton et al. ..... 707/104.1
2005/0172789 A1 * 8/2005 Hsu et al. ..... 84/645
2005/0202385 A1 * 9/2005 Coward et al. ..... 434/307
2006/0005692 A1 * 1/2006 Moffatt ..... 84/645
2006/0011042 A1 * 1/2006 Brenner et al. ..... 84/600
2006/0054006 A1 * 3/2006 Akazawa ..... 84/609
2007/0087686 A1 * 4/2007 Holm et al. ..... 455/3.06
2007/0124452 A1 * 5/2007 Mohammed ..... 709/223
2007/0131098 A1 6/2007 Moffatt
2007/0157259 A1 * 7/2007 Koplar et al. ..... 725/81
2007/0261535 A1 * 11/2007 Sherwani et al. ..... 84/609

* cited by examiner

METHOD TO PLAYBACK MULTIPLE MUSICAL INSTRUMENT DIGITAL INTERFACE (MIDI) AND AUDIO SOUND FILES

CROSS-REFERENCE TO RELATED APPLICATION(S)

This application claims priority to U.S. Provisional Patent Application No. 60/742,487, filed Dec. 5, 2005, which is incorporated herein by reference in its entirety.

TECHNICAL FIELD

The present invention relates generally to the field of music. More specifically, the present invention relates to music performance for live and studio music production.

BACKGROUND OF THE INVENTION

In the past and present, music creation is produced by musicians performing on traditional and contemporary musical instruments. These performances, particularly pop and rock music is at times supplemented with "loops" or "sequences"; sound tracks that extend the musical content of the performance. In sound track enhanced performance, the musicians synchronize their performance with the active sound track assuming the sound track tempo and key. The combined content of live and pre-recorded music results in the complete musical output of the performance.

For example, a performer on tour has a financial budget that supports ten musicians. The music to be performed is orchestrated for a larger group. Loops/sound tracks are created to extend and enhance the live performance supplementing the performance of the touring musicians. The collection of sound tracks created are "static" and are not intended for real time modification in tempo or tonality during the live performance. Moreover, the playback of the sound track during live performance in many cases is controlled by a sound technician(s) and not the direct responsibility of the performing musician.

The format of these sound tracks are often audio files such as .mp3, .wav or other high quality sound file. Audio sound files contain data that represent the music in terms of the properties of the sound reproduction and is not a representation of the underlying composed music. Conversely, the MIDI (Musical Instrument Digital Interface) file format is a binary representation of note sequences, key signatures, time signatures, tempo settings and other metadata that comprise a complete musical composition. While the MIDI file contains information that determines the instrumentation and the duration of note values to be played by various instruments and other, it does not specify the actual sound output in terms of quality. It is simply a representation of the underlying music composition. A MIDI output device (a keyboard or audio player that supports MIDI or other device) is used to interpret the embedded MIDI messages in the file and provide the sound output referencing its sound library in accordance with the MIDI specification.

This use of sound tracks is intended to enhance and extend the performance of live musicians performing on conventional musical instruments. Since the sound tracks themselves are static or fixed, they are used for specific purposes within the performance and do not change. Sound tracks in the form of loops are not typically used or controlled by the performing musician using conventional performance instruments. Further they are not used for improvisation or spontaneous music invention. Hence, the application of this performance resource is currently limited to a supplemental or background performance role.

Consequently, there is a need in the art for a sound track player that enables musicians to control, modify and synchronize the playback of sound tracks in real time during performance. The sound track player would support real time improvisation, modification of the source sound track (or sound resource) and enable individual musicians real time interactive control and management of a library of sound resource for references during performance. The result of such a sound track player would enable the role of sound resources to elevate from supplemental/background to essential and focal; assuming a dominant role in the performance.

BRIEF SUMMARY OF THE INVENTION

The present invention, in one embodiment, is an interactive, real time file playback system for live and studio music performance. Unlike standard file playback technology consisting of one source sound file and one device for output, this playback system, or player, supports the simultaneous and real time synchronization of multiple MIDI and/or audio sources to one or more output devices. Individual clients communicate with the player host through the host command interface. The command interface receives commands from client entities and sets playback configuration parameters, stores and manages playback resources and performs real time performance operations. The player services these requests, manages and routes output to the appropriate output device(s).

In a further embodiment of the present invention, the playback system can be configured to assist people with physical or mental disabilities enabling them to participate with musicians of all skill levels.

While multiple embodiments are disclosed herein, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
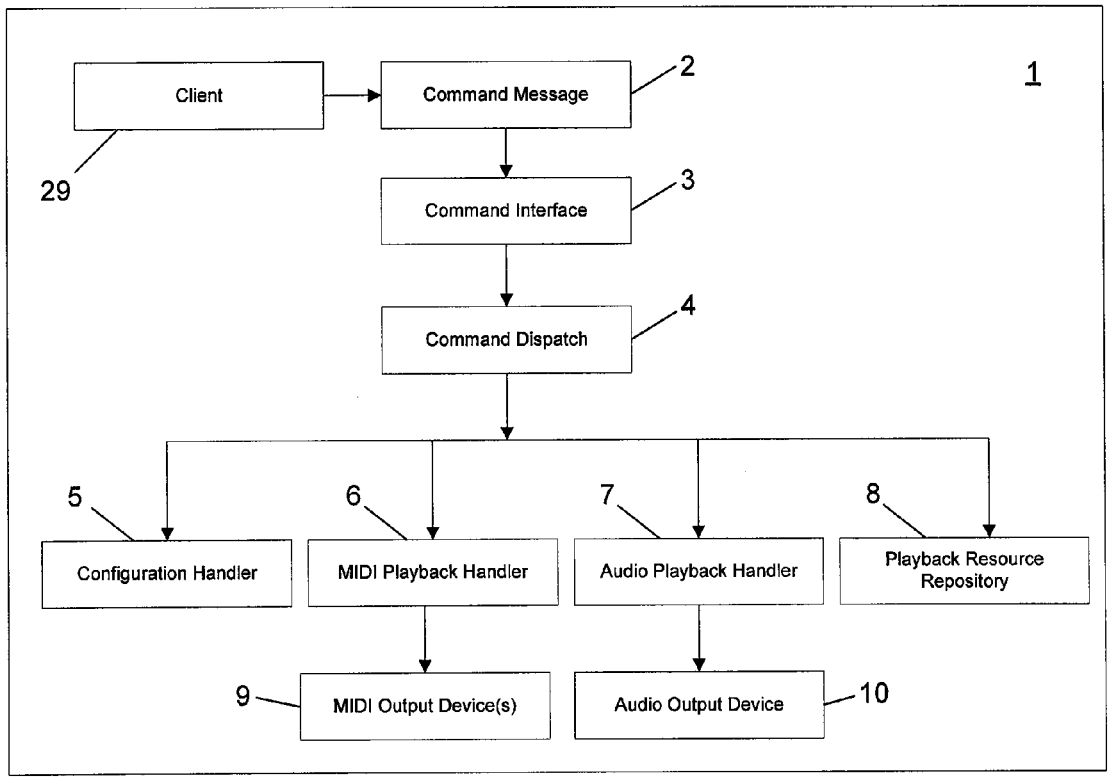
FIG. 1 is a block diagram of one embodiment of the functional components.

FIG. 1 shows a diagram outlining the functional components of the playback apparatus 1 of one embodiment of the present invention. As shown in FIG. 1, the playback apparatus 1 includes a command interface 3 that receives command messages 2 from a client 29. The client 29 may be a physical device, software object or any entity that can communicate command messages 2 with the command interface 3. The command interface 3 is responsible for parsing and validating the command message 2 and forwarding valid messages to the command dispatch 4. The command dispatch 4 examines the received command message 2 and routes the command message 2 to the appropriate command handler: configuration handler 5, MIDI playback handler 6, audio playback handler 7 or playback resource repository 8. All command handlers (5,6,7,8) are singleton object instances. Meaning, only one instance of each handler exists in the playback apparatus 1. MIDI playback handler 6 and audio playback handler 7 are responsible for sound output. Wherein MIDI playback handler 6 sends output to MIDI output device(s) 9 and audio playback handler 7 sends output to audio output device 10. In a further embodiment, multiple instances of playback handlers (6,7) may be implemented referencing a central metronome internal clock.

Figure 2:
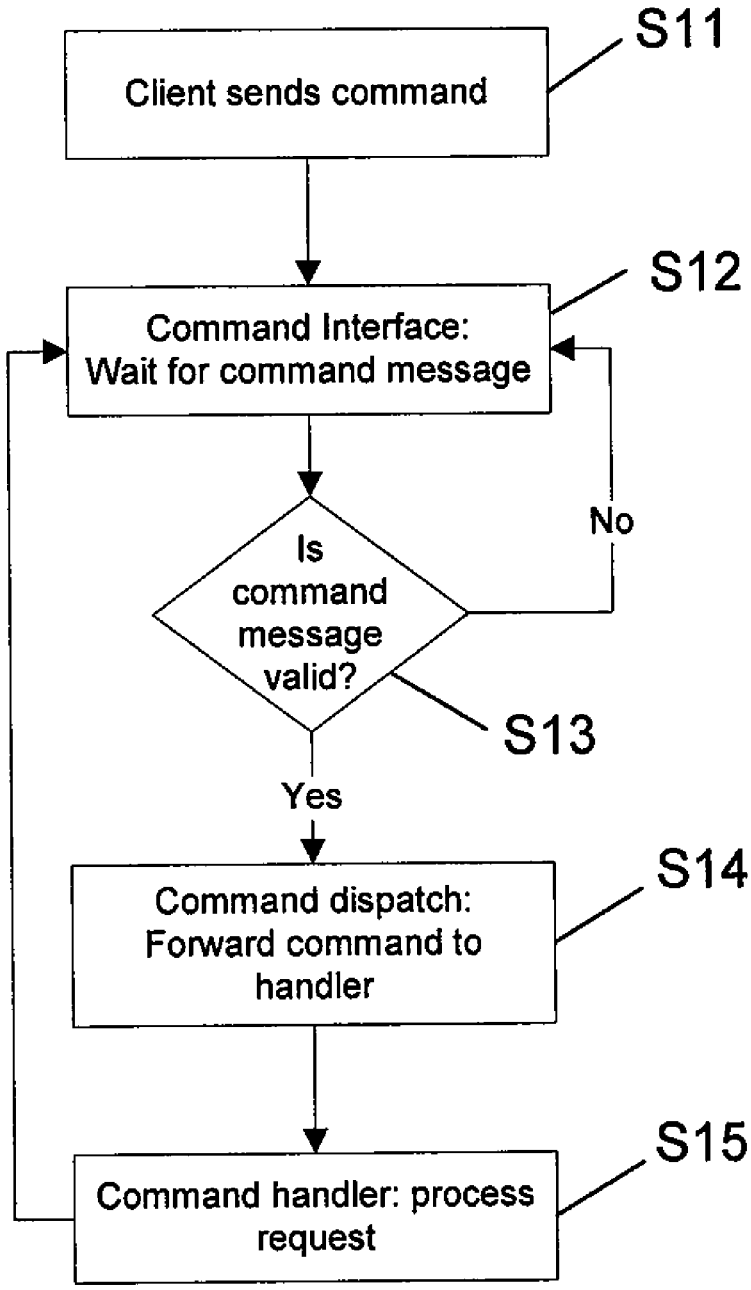
FIG. 2 is an activity diagram illustrating the flow of command processing in the embodiment of the present invention.

FIG. 2 is a flow diagram of command message handling in one embodiment of the present invention. As illustrated in FIG. 2, the client sends a command S11 to the command interface 3 where the command interface is in a wait state S12 for the receipt of a command message 2. Upon receipt of the client sent command message, the message is validated S13. If the command message 2 is not valid, the command interface 3 returns to wait state S12. If the received command message 2 is valid, the message is forwarded by the command dispatch S14 to a command handler S15 for processing.

Figure 3:
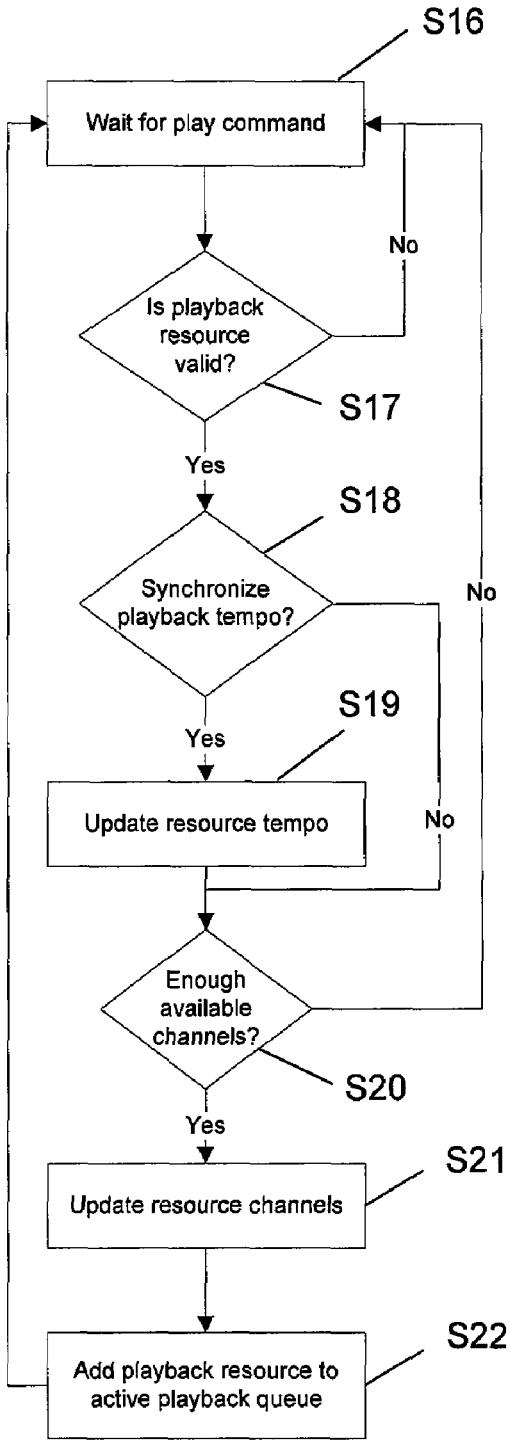
FIG. 3 is an activity diagram illustrating the activation of a playback resource.

FIG. 3 is an activity diagram illustrating the process to activate a playback resource in playback apparatus 1 in one embodiment of the present invention. As illustrated in FIG. 3, the playback handler (6 or 7) remains in a wait state S16 until a command message 2 to play is received. The received play command message 2 contains a reference to a playback resource and playback attributes that provide playback parameters to the playback handler (6 or 7). The referenced playback resource is validated S17 with the playback resource repository 8. If the playback reference is invalid or disabled, the process returns to the wait state S16. If the playback reference is valid S17, the synchronize playback tempo attribute is examined. If the synchronize playback tempo S18 is set to true, the playback resource tempo is updated S19 to the internal playback metronome. If the synchronize playback tempo S18 is false, the playback resource tempo is not modified. The process then examines the playback channel requirement for the playback resource S20. If the playback handler (6 or 7) has adequate channels for playback S20, the playback resource channels are dynamically assigned and the playback resource channels are updated S21. The playback resource is activated and added to the playback queue S22.

Figure 4:
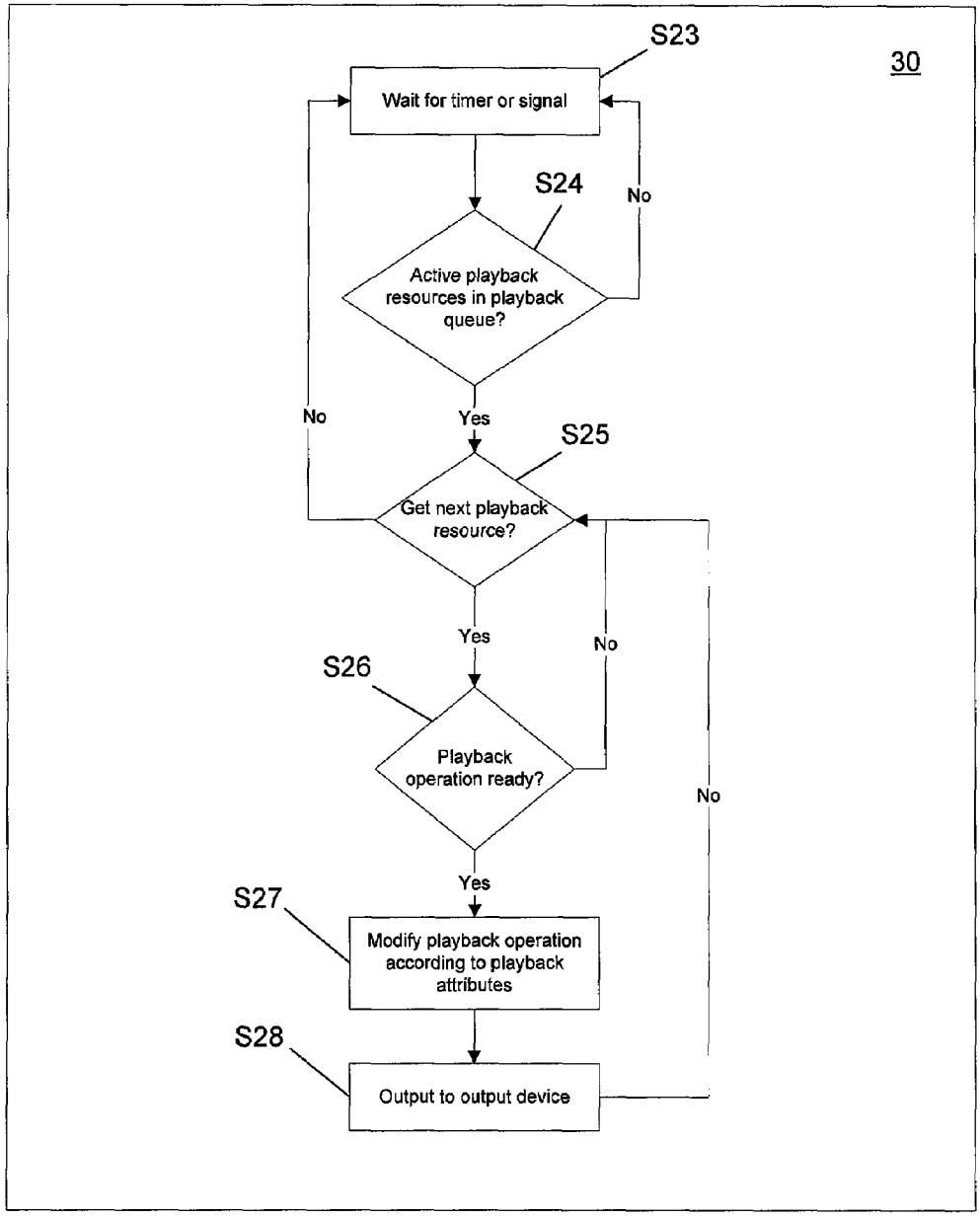
FIG. 4 is an activity diagram illustrating the real time processing of an active playback resource(s).

FIG. 4 is an activity diagram illustrating the processing of active playback resources in the playback queue. The playback process 30 waits for timer expiration or thread signal S23 to begin processing active playback resources. Upon signal the playback queue is examined for active playback resources S24 contained in the playback queue. If no resources exist in the playback queue, the process returns to the wait state S23. If one or more playback resources exist in the playback queue, the process traverses the playback queue S25 and process each playback resource. If a playback operation or output event is in the ready state S26, the playback resource and operation is modified according to the parameters contained in the playback attributes S27 and output to the output device S28. These real time modifications to playback output events include playback quantization, key transposition, dynamic, expression and other musical or sound variations.

Although the present invention has been described with reference to preferred embodiments, persons skilled in the art will recognize that changes may be made in form and detail without departing from the spirit and scope of the invention.

I claim:

1. An interactive, real time MIDI file and sound file processor comprising:

a command interface configured to receive client configuration, MIDI, and audio file processing commands;

at least one client actuator configured to transmit the configuration, MIDI, and audio file processing commands to the command interface;

a command dispatch processor that routes the configuration, MIDI, and audio file processing commands from the command interface to an appropriate command handler;

a processing computer configured to provide communication services for command and command response communication and provide output support for MIDI and audio files;

a system configuration command handler that receives the configuration processing commands from the command dispatch processor to process runtime configuration parameters;

a MIDI file playback handler that receives the MIDI processing commands from the command dispatch processor to process active MIDI files for sound output;

an audio file playback handler that receives the audio file processing commands from the command dispatch processor to process active sound files for sound output;

a playback resource repository that manages and maintains MIDI and audio files referenced in the MIDI and audio file processing commands and the MIDI and audio playback handlers;

at least one MIDI output device;

an audio output device; and at least one speaker configured to receive a MIDI or audio output signal from the at least one MIDI output device or the audio output device and emit sound based on the output signal.

2. The apparatus of claim 1 wherein an action at the client actuator is interactive with the sound based on the output signal.

3. The apparatus of claim 1 wherein the client actuator is a physical device or class object.

4. The apparatus of claim 3 wherein the client actuator receives processing command response messages providing feedback relating to the client configuration, MIDI, and audio file processing commands.

5. The apparatus of claim 3 wherein the playback resource repository manages and persists sound resources such as MIDI and audio files.

6. The apparatus of claim 5 wherein the MIDI and audio files are added or removed from the playback resource repository via a command to the command interface.

7. The apparatus of claim 5 wherein the playback resource repository publishes relevant data, including the name, associated with at least one of the MIDI or audio files contained within the repository to the client.

8. The apparatus of claim 7 wherein the configuration parameters control the behavior of the command handlers.

9. The apparatus of claim 3 wherein the processing commands from the command dispatch processor to process runtime configuration parameters are implemented at runtime and persisted for reference in future uses.

10. The apparatus of claim 3 wherein a client sends a play command referencing a MIDI or audio file in the playback resource repository to the command interface, instructing the MIDI or audio file playback handler to activate a MIDI or audio file for sound output.

11. The apparatus of claim 10 wherein the play command comprises one or more playback attributes that may modify the output of the original source MIDI or audio file.

12. The apparatus of claim 11 wherein the playback attributes at least one of modify the tempo, modify the key of, modify the dynamics of, modify the transposition of, modify the expression of, or include additional signal processing to the original source MIDI or audio file.

13. The apparatus of claim 11 wherein the playback attributes further define attributes of the MIDI or audio file that specify the time duration that the MIDI or audio file remains active.

14. The apparatus of claim 11 wherein further comprising an internal metronome, and a playback quantization attribute indicates whether the MIDI or audio file is to begin at substantially the next downbeat or to begin at the time of receipt of the command without regard to the internal metronome.

15. The apparatus of claim 14 wherein the playback quantization attribute includes a tolerance of time after the downbeat of the internal metronome in which playback may begin.

16. The apparatus of claim 10 wherein one or more MIDI channels of a MIDI file are dynamically reassigned as needed by the MIDI file playback handler.

17. The apparatus of claim 10 further comprising a playback queue wherein the play command adds a MIDI or audio file to the active playback queue.

18. The apparatus of claim 10 wherein the playback handlers are configured to provide a callback notification message that indicates information concerning playback of the MIDI or audio file.

19. The apparatus of claim 1 wherein the MIDI and audio file playback handlers maintain an internal metronome clock that enables MIDI or audio files to synchronize to a common tempo.

20. The apparatus of claim 19 wherein a client of the apparatus subscribes to receive metronome clock notification indicating downbeat.

21. The apparatus of claim 19 wherein the tempo of the internal metronome clock is changed at runtime by a processing command from a client of the apparatus.

* * * * *